United States Patent [19]

Pomante

[11] 4,151,643

[45] May 1, 1979

[54] TOOL TO ALTER SAFETY CLOSURE TO NON-SAFETY STATUS

[76] Inventor: August E. Pomante, 717 Fernwood Dr., West Palm Beach, Fla. 33405

[21] Appl. No.: 819,832

[22] Filed: Jul. 28, 1977

[51] Int. Cl.[2] ..... B26B 17/02

[52] U.S. Cl. ..... 30/1.5; 30/172; 30/193

[58] Field of Search ..... 30/1.5, 176, 177, 182, 30/193, 272 R, 287, 299, 304, 178

[56] References Cited

U.S. PATENT DOCUMENTS

| | | | |
|---|---|---|---|
| 435,414 | 9/1890 | Fisher | 30/176 X |
| 665,920 | 1/1901 | Loeser | 30/1.5 X |
| 787,348 | 4/1905 | Hansen | 30/178 |
| 1,580,884 | 4/1926 | Goff | 30/193 X |
| 2,722,740 | 11/1955 | Hubbard | 30/182 |

*Primary Examiner*—Gary L. Smith

[57] ABSTRACT

A tool for cutting away the outer cap of a safety closure so that a remaining inner cap of the closure can be retained for screwing on and off a bottle, in order that it may be used by a knowledgable adult; the tool comprising a pliers-like implement, in which one of the jaws includes a stage upon which the closure is placed, and the other jaw of the implement includes a cutting blade, that cuts or slits only through the side wall of the outer cap member of the closure.

1 Claim, 10 Drawing Figures

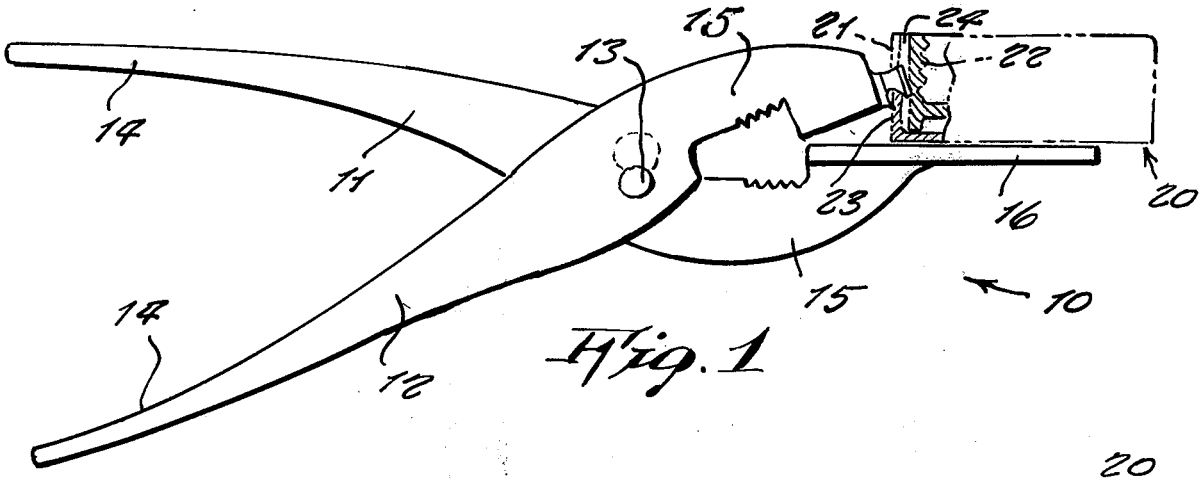
Fig. 1
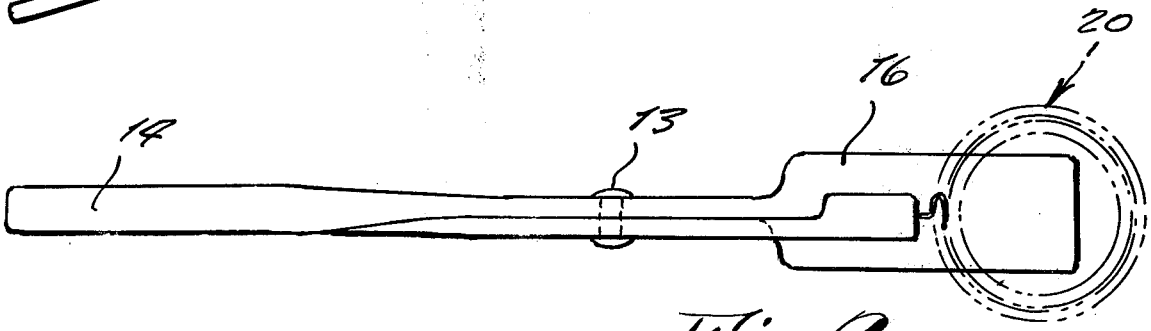
Fig. 2
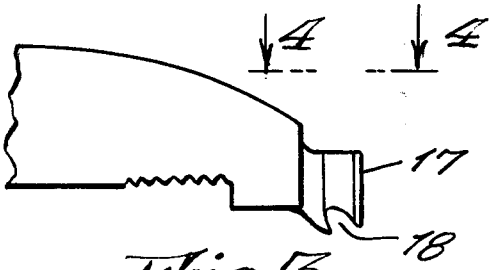
Fig. 3
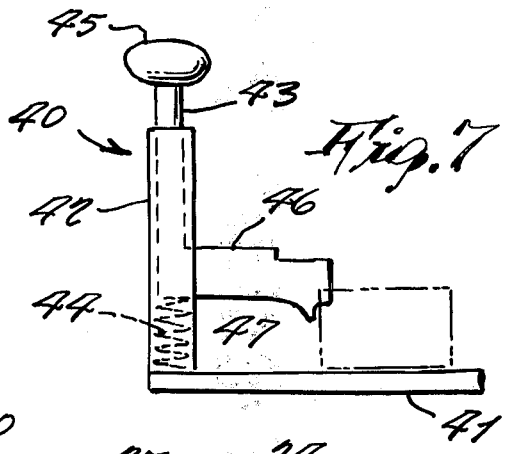
Fig. 7
Fig 4a
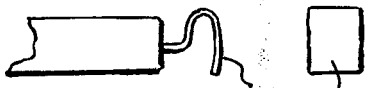
Fig. 4
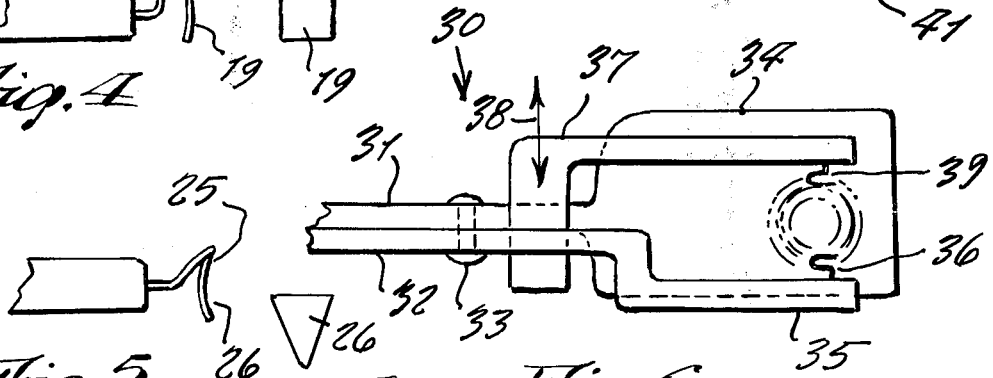
Fig. 5
Fig. 5a
Fig. 6

TOOL TO ALTER SAFETY CLOSURE TO NON-SAFETY STATUS

This invention relates generally to hand tools. More specifically, it relates to cutting implements.

It is generally well known, to those skilled in the art, that it is now mandatory to package certain drugs, chemicals and prescription products in containers that are closeable by what are called safety closures. This law is designed to protect the health and welfare of young children, in order that they do not become accidentally injured or harmed by these products. The law also states that, at the request of a patient receiving a medication, or with a prescribing physician's consent, that the medicines can be dispensed without a safety closure. However, since many containers in the pharmaceutical, chemical and drug industry already have a non-safety closure, and the average retail pharmacy or merchant does not have an alternate cap to place on the container, it becomes a problem to alter a safety closure into a non-safety closure. This situation is, of course, objectionable, and is, therefore, in want of improvement.

Therefore, it is the principal object of the present invention to provide a special cutting tool, whereby a safety closure is readily convertible into a non-safety closure.

Another object is to provide a cutting tool which can be quickly and readily operated manually, so as to cut off an outer cap of a safety closure, and thus leave only the inner cap of the safety closure for utility.

Other objects are to provide a tool for altering a safety closure to a non-safety status, and which is simple in design, inexpensive to manufacture, rugged in construction, easy to use and efficient in operation.

These, and other objects, will be readily evident, upon a study of the following specification, and the accompanying drawing, wherein:

FIG. 1 is a side elevation view of the present tool, shown in operative use;

FIG. 2 is a top view thereof;

FIG. 3 is an enlarged side elevation view, showing the cutting blade of the tool;

FIG. 4 is a view thereof, as viewed on line 4—4 of FIG. 3;

Figure 8:
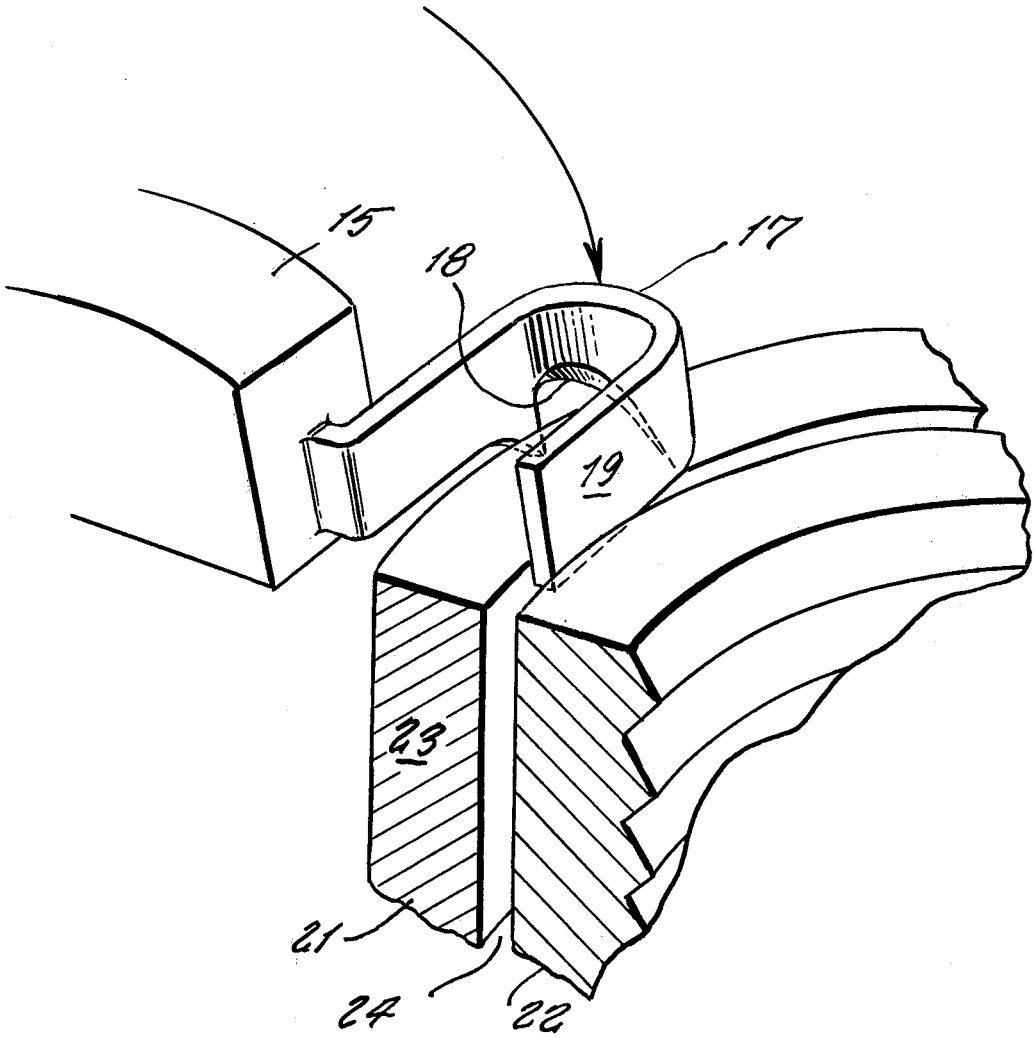

FIG. 4*a* is an end view of the blade shown in FIG. 4;

FIG. 5 is a top view of a modified design of the blade;

FIG. 5*a* is an end view of the blade illustrated in FIG. 5;

FIG. 6 is a top view of a modified design of the invention, in which a safety closure outer cap is slitted simultaneously on opposite sides thereof; and FIG. 7 is a side view of still another modified design of the invention; and FIG. 8 is a greatly enlarged perspective view of the cutting blade, shown in operative use.

Referring now to the drawing in greater detail, and more particularly to FIGS. 1 through 4*a*, the reference numeral 10 represents a special cutting tool, according to the present invention, which is comprised of two crossing levers 11 and 12, which are pivotable about a pivot rivet 13, along longitudinally intermediate portions of the levers. One ends of the levers form handles 14, while opposite ends of the levers form jaws 15.

One of the jaws has a flat platform 16 integrally formed thereupon, while the opposite jaw has a configurated blade 17 formed upon the terminal end thereof. As is clearly shown in FIGS. 3, 4 and 4*a*, a lower edge of the blade includes an upward slot 18, and this arcuately upward notch is sharpened. The blade, additionally, includes a guide lip 19, which extends at right angle to the direction of the cutting blade edge 18.

In operative use, a closure cap 20 is placed upon the stage or platform 16, the safety closure being comprised of an outer cap 21, within which there is an inner cap 22.

In order to remove the outer cap from the inner cap, the handles are closed together, so that the cutting blade is brought down, in order to slit the side wall 23 of the outer cap. During this operation, the lip 19 travels within a space 24, formed between the caps, in order to prevent slitting of the inner cap. Thus, the cutting edge 18 of the blade cuts only through the side wall of the outer cap. After this operation is completed, the safety closure is turned 180 degrees upon the platform, and the operation is again repeated, so that the safety closure is thus slitted on diametrically opposite sides. The slits thus being completed, the outer cap can be folded outwardly, so that the inner cap will readily drop out therefrom.

In FIGS. 5 and 5*a*, a modified design of the blade 25 incorporates all the principles of the above described blade 18, except that it is differently shaped. Thus, it will be noted that the lip 26 hereof is arcuate to conform to the shape of a slot 24 between the caps. Likewise, the lip is downwardly tapered, instead of being rectangular.

In FIG. 6, a modified design of a cutting tool 30 includes levers 31 and 32, pivoted about pivot rivet 33, and a jaw of the lever 31 includes the platform 34. The other lever 32 has a jaw 35, upon which a blade 36 is formed, in a right angled direction, so as to differ from the direction of the blade shown in the cutting tool 10. An arm 37, of L-shape, is supported on the lever 32, and is slideable thereupon, as is indicated by arrow 38, so that a blade 39, formed upon the end of the arm, can be moved closer or further away from the blade 36, in order to accomodate safety closures of different sizes. Thus, in this design, two slits can be accomplished at a same time.

In FIG. 7. another modified design of cutting tool 40 includes platform 41, which, upon one end thereof, has a sleeve 42, within which a bar 43 is vertically slideable against a compression coil spring 44, located in a bottom of the sleeve. An upper end of the bar is provided with an enlarged knob 45, so that it may be comfortably manually depressed, and thus move the bar against the spring. A sideward extension 46 projects out a slit of the sleeve, and the outer end of the projection 46 is provided with a cutting blade 47, so that it may be used to perform the above described operation, of cutting away an outer cap of a safety closure which rests upon the platform 41.

Thus, different forms of the invention are indicated. While various changes may be made in the detail construction, it is understood that such changes will be within the spirit and scope of the present invention, as is defined by the appended claims.

What I now claim is:

1. A cutting tool for cutting away an outer cap of a safety closure, comprising in combination, a platform upon which said safety closure is placed, and a blade movable to slit a side wall of said outer cap; said blade comprising a generally "U"-shaped member in which a terminal leg thereof comprises a guide for insertion between said outer cap and an inner cap of said safety closure while an intermediate leg of said generally "U"-shaped blade includes a sharpened notch; said cutting